United States Patent [19]

Junker

[11] Patent Number: 4,989,377

[45] Date of Patent: Feb. 5, 1991

[54] APPARATUS FOR INTERNAL GRINDING

[76] Inventor: Erwin Junker, Talstr. 78, 7611 Nordrach-Baden, Fed. Rep. of Germany

[21] Appl. No.: 568,664

[22] Filed: Aug. 15, 1990

Related U.S. Application Data

[63] Continuation of Ser. No. 283,710, Dec. 13, 1989, abandoned.

[51] Int. Cl.[5] ..... B24B 5/00

[52] U.S. Cl. ..... 51/165.93; 51/103 R; 51/95 WH; 51/290

[58] Field of Search ..... 51/103 R, 48 R, 50 R, 51/165.93, 95 R, 56 R, 95 WH, 123 R, 290

[56] References Cited

U.S. PATENT DOCUMENTS 998,508 7/1911 Hattersky et al. ..... 51/50 R
2,187,471 1/1940 Hutchinson ..... 51/50 R
2,612,008 9/1952 Kuniholm et al. ..... 51/290 X
4,709,508 12/1987 Junker ..... 51/50 R

*Primary Examiner*—Frederick R. Schmidt
*Assistant Examiner*—M. Rachuba
*Attorney, Agent, or Firm*—Jordan and Hamburg

[57] ABSTRACT

Apparatus for internally grinding rotationally-symmetrical workpieces, the grinding disc of which only abuts against the end face of the workpiece and has a generatrix which extends in a substantially flat manner and, by subtending a small clearance anle, is guided towards the area of the workpiece to be machined, a further clearance angle being formed by an offset disposition of the axes of the grinding disc and of the workpiece relative to one another, the point of contact between the grinding disc and the completely ground workpiece face being offset by a dimension D relative to the central axis of the workpiece.

3 Claims, 5 Drawing Sheets

FIG. 1
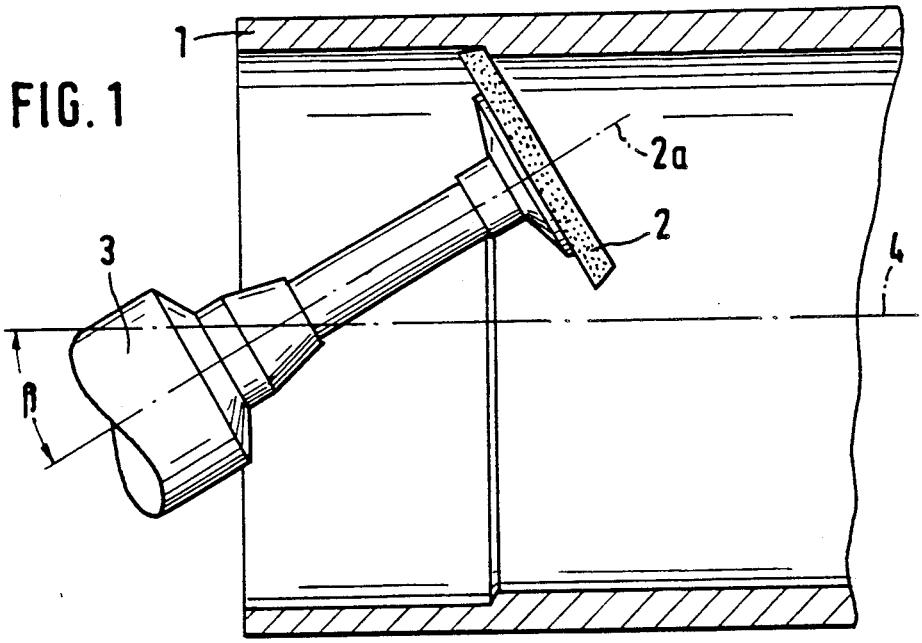
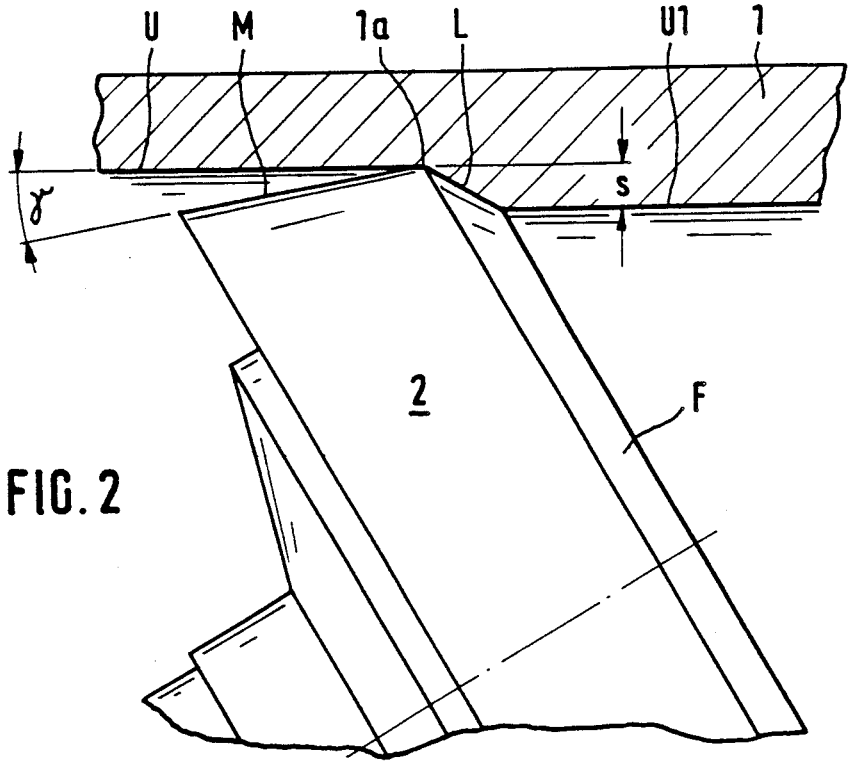
FIG. 2

B-B

FIG. 7
A-A
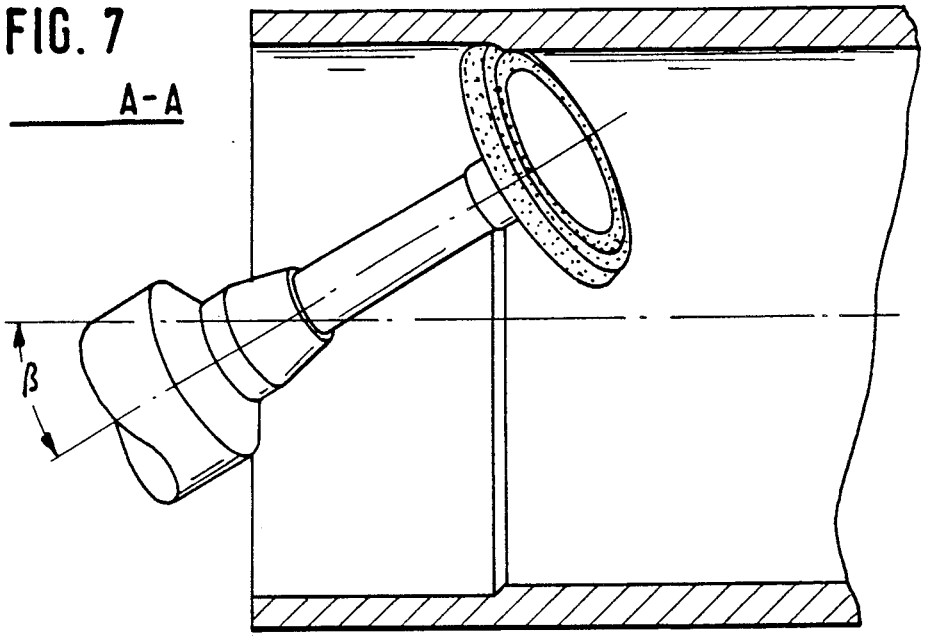
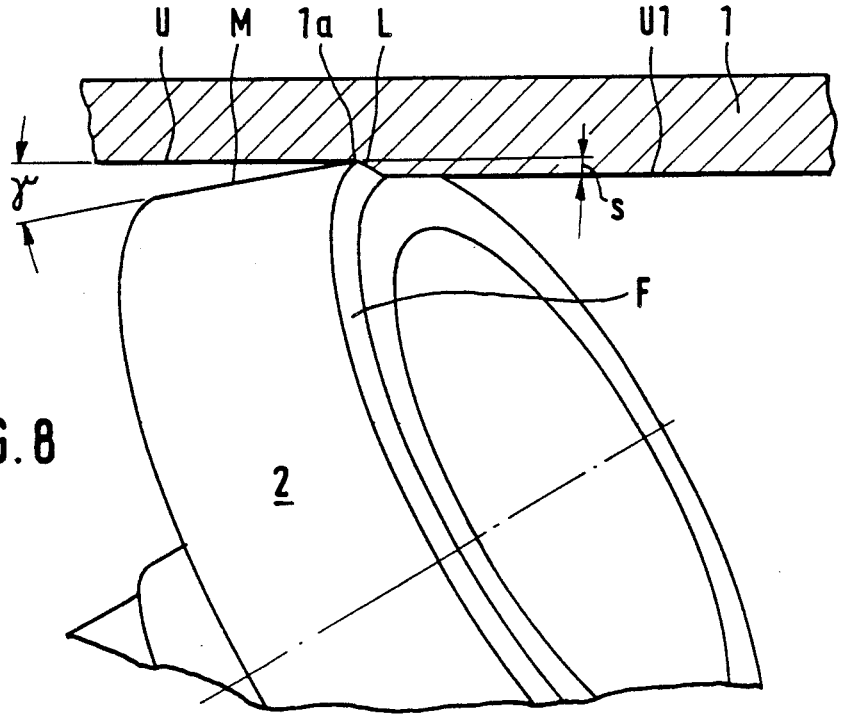
FIG. 8

APPARATUS FOR INTERNAL GRINDING

This application is a continuation, of application Ser. No. 283,710, filed Dec. 13, 1988 now abandoned.

BACKGROUND OF THE INVENTION

The invention relates to an apparatus for internally grinding rotationally-symmetrical workpieces, which are clamped in position in a grinding machine so as to be rotatable about their longitudinal axis, the apparatus having a grinding disc which is displaceable longitudinally of the rotational axis of the workpiece and is radially feedable according to the internal profile to be ground.

When rotating bodies are internally ground, it is usual practice to utilize grinding discs with a ratio of diameter to length of >0.3. A grinding disc according to German Offenlegungsschrift No. 2 410 805 and German Offenlegungsschrift No. 2 336 705 has the disadvantage that it actually reduces the whole extent of grinding with its inclined end face when it passes once through the workpiece, but it is simultaneously the caliber for the finished dimension of the bore. In such a case, there is linear contact continuously between the bore face and the surface of the cylindrical portion of the grinding disc, with the result that the coolant does not act in its optimum manner. In order to keep the heating of the workpiece within limits, the operation is generally carried out at relatively low cutting speeds. In consequence, the operation takes a relatively long time, thereby increasing the workpiece costs accordingly. Moreover, the known grinding discs have to be trimmed whenever a workpiece is changed.

Furthermore, it is known from German Patent Specification No. 3 435 313 to effect external grinding of rotationally-symmetrical workpieces with a spindle which is mounted in an offset manner. However, the process described there cannot be readily applied to internal grinding because, firstly, in the case of the latter method the space available for the grinding disc when machining the bore is limited and, secondly, when the grinding spindle is solely disposed in an offset manner relative to the longitudinal axis of the workpiece, the disc does not have the desired grinding effect.

SUMMARY OF THE INVENTION

According to the invention, this object is achieved for internal grinding, when the grinding disc, which only abuts against the end face of the workpiece, has a generatrix which extends in a substantially flat manner and, by subtending a small clearance angle, is guided towards the area of the workpiece to be machined, and a further clearance angle is formed by the offset disposition of the axes of the grinding disc and of the workpiece relative to one another, the point of contact between the grinding disc and the completely ground workpiece area being offset by a dimension D relative to the central axis of the workpiece.

The clearance angle is advantageously formed by a cylindrically trimmed grinding disc, the axis of which subtends, with the longitudinal axis of the workpiece, an angle greater than zero.

The essential advantage of this proposal according to the invention resides in the fact that, whilst reducing the tool costs, the grinding period is considerably shortened, and very little heat is produced. Apart from the fact that an accumulation of heat in the workpiece is precluded, because, when a flat grinding disc is employed, the cooling process can be effected in a substantially more concentrated manner than was possible hitherto, the workpiece is not subjected to any extreme radial grinding forces because, firstly, the active face of the grinding disc, which is in engagement with the workpiece, is relatively small and, moreover, a considerable portion of the grinding forces is transferred in a axial direction. An accumulation of air is eliminated because of the clearance angle which is provided between the generatrix of the grinding disc and the completely ground workpiece face, so that the coolant is available at the location where effective grinding is carried out.

In order to achieve optimum grinding efficiency and grinding quality, the advantageous ratio of the grinding disc diameter relative to the internal diameter of the cylindrical hollow body to be machined is ascertained, since this ratio determines the area where the grinding disc engages with the workpiece. In such a case, additional determinative parameters are as follows:

the attainable r.p.m. of the workpiece and grinding disc;
the depth of insertion (feed depth);
the material;
the grinding disc specification;
the speed of advancement; and
the pivotal angle.

Whilst optimizing the above-mentioned parameters, the operation can be effected at relatively high cutting speeds, because, in contrast to conventional grinding, the forces which act at right angles to the axis, only account for a fraction, and these forces act only at one point of the completely ground workpiece face.

An additional advantage resides in the fact that the grinding disc wears away uniformly towards one side in the form of a thin layer, that is to say it wears away in successive layers longitudinally along its circumference. It can be ascertained previously, therefore, when a layer has been worn from the grinding disc circumference, so that it can be subsequently re-aligned. If the grinding body is provided with a so-called CBN coating, the service-life is substantially increased.

Because of the inclined or offset disposition of the grinding disc relative to the workpiece to be machined, a clearance angle is produced between the generatrix and inner circumferential line of the workpiece, which angle is in the range of from 0.06° to 0.2°, so that the grinding disc only acts upon the workpiece at the envisaged location; otherwise, however, space is left so that the grinding disc cannot grind again the finished internal profile when the grinding process is continued.

The error, which is produced by the clearance angle in the event of lateral wear of the grinding disc, lies in the $\mu$ range and is minimal.

BRIEF DESCRIPTION OF THE DRAWINGS

The invention is explained more fully hereinafter with reference to one embodiment which is shown in the drawings. In the drawings:

FIG. 1 is a schematic, partial cross-sectional view of the disposition of the grinding disc relative to the workpiece, the rotational axis of the grinding disc being pivoted horizontally relative to the longitudinal axis of the workpiece;

FIG. 2 is an enlarged, partial view of FIG. 1;

FIGS. 6 and 7 are schematic views of a grinding disc which has been attached to the internal circumference of the rotationally-symmetrical workpiece, a further clearance angle δ in FIG. 6 being formed by the offset disposition of the axes of the grinding disc and workpiece relative to one another;

FIG. 8 is a partial view of the workpiece and grinding disc, a clearance angle γ being formed by the inclined position of the grinding disc relative to the rotationally-symmetrical workpiece;

FIG. 10 is a schematic sectional view of the workpiece to show the punctiform contact of the disc with the workpiece;

DETAILED DESCRIPTION OF A PREFERRED EMBODIMENT

FIGS. 1 and 2 show a rotationally-symmetrical, hollow rotating body, namely a workpiece 1, with which a narrow grinding disc 2 engages. The rotational axis 2*a* of this grinding disc 2 is pivoted through an angle β horizontally relative to the longitudinal axis 4 of the workpiece. FIG. 5 shows that, by vertically pivoting the rotational axis 2*a* of the grinding disc relative to the workpiece axis 4, a further limitation angle α d is produced. The inclined position of the grinding disc relative to the workpiece during the grinding operation is explained more clearly hereinafter with reference to FIGS. 3 and 4.

Figure 3:
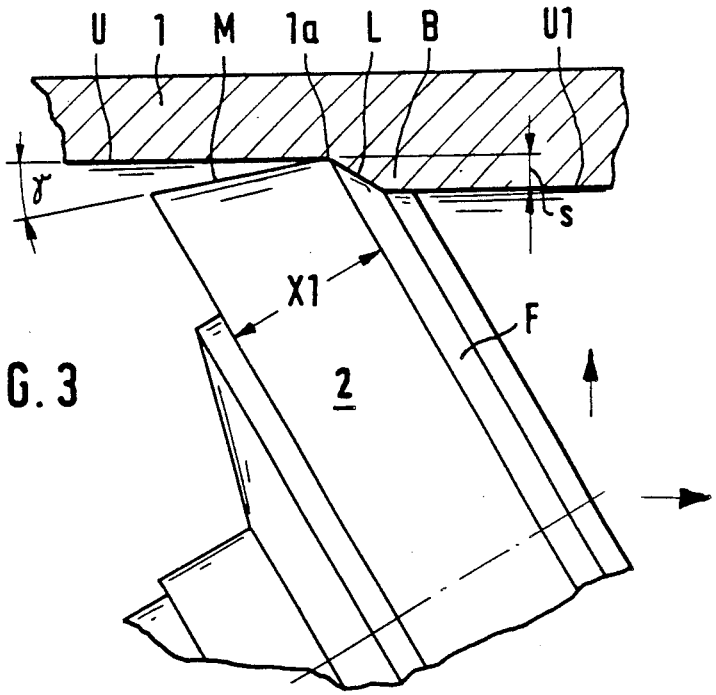
FIGS. 3 and 4 are views similar to FIG. 2, the degree of wear of the grinding disc being 10% and 80% respectively.
Figure 4:
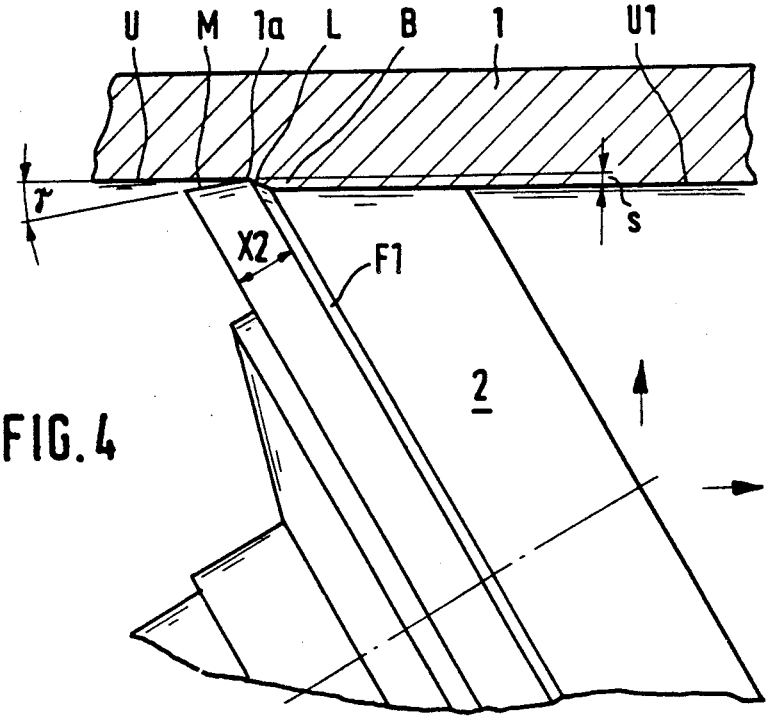
Figure 5:
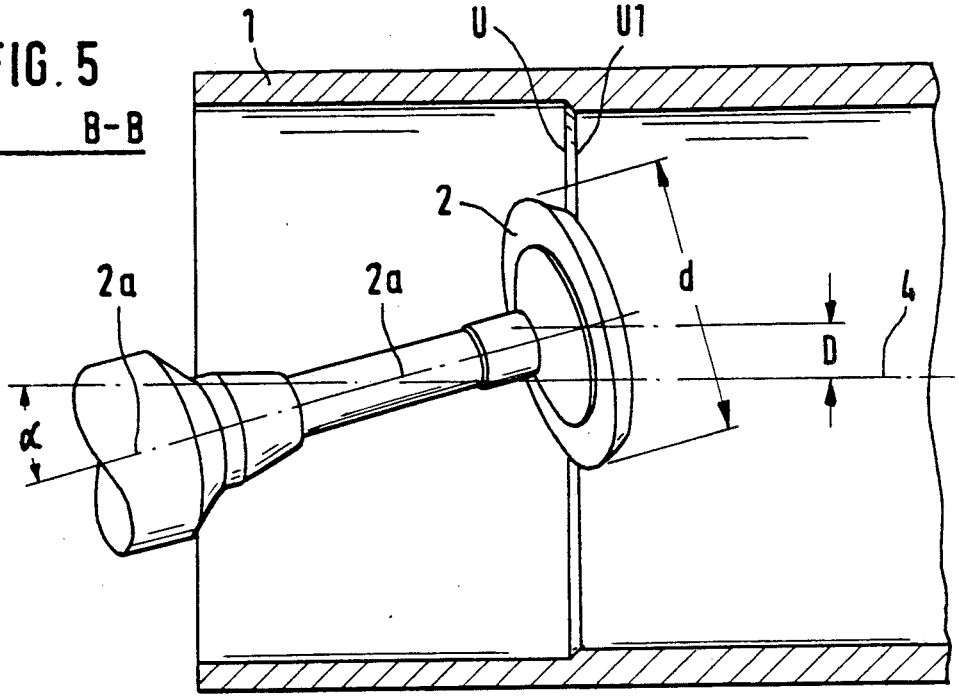
FIG. 5 is a view of the arrangement shown in FIG. 1, taken along the line B—B of FIG. 6, the rotational axis of the grinding disc being pivoted vertically relative to the longitudinal axis of the workpiece.

According to FIGS. 3 and 4, the grinding disc 2, which has a substantially flat surface, engages at an angle with the internal circumference U1 of the workpiece, from which, corresponding to the infeed or desired grinding dept S, a predetermined portion of the surface thickness B is to be ground away. In such a case, the rotational axis 2*a* of the grinding disc is offset by the dimension D relative to the rotational axis of the workpiece (FIG. 5).

This is necessary in order to free the grinding disc in the completely ground region when the rotational axes 2*a* and 4 are disposed in an offset manner. At the beginning, an inclined face F is provided, by means of which the grinding disc engages with the portion L of the workpiece which is to be ground, while, because of the particular disposition of the grinding disc relative to the workpiece, a clearance angle γ exists between the straight generatrix M of the grinding disc and the completely ground face U of the workpiece 1, so that, whenever the face U is completely ground, it does not come into contact further with the grinding disc. While a considerable portion of the pressure of the grinding disc is transmitted here in a axial direction via the line L of FIG. 3, the radially directed grinding force component merely acts upon the completely ground workpiece face at the point which is referenced 1*a* in FIGS. 2, 3, 4 and 8. When the grinding process is continued, the end face F travels in a direction opposite the direction of advancement of the grinding disc relative to the free edge of the disc, as shown in FIG. 4, where 80% of the grinding disc has already worn away in the form of a layer. In FIG. 4, the inclined end face of the grinding disc is denoted by F1.

FIGS. 3 and 4 are schematic, simplified views of the wear of the grinding disc, where there is a clearance angle γ between the flat generatrix M of the grinding disc 2 and the internal wall U of the workpiece 1 of the already completely ground diameter of the workpiece 1. According to FIGS. 3 and 8, the grinding disc 2 acts with its inclined end face F against the machined layer B of the workpiece 1, corresponding to the desired grinding depth S. The arrows indicate the radial feed and the axial movement of the grinding disc 2 relative to the workpiece 1. During the grinding process according to FIGS. 3 and 4, however, not only is the bore diameter of the workpiece 1 increased by twice the grinding depth, but the grinding disc 2 wears successively during the grinding process in the form of a layer L which corresponds to the grinding depth S. During the grinding process itself, a considerable portion of the grinding pressures acts in the axial direction, while the radial component of these forces being transferred from the grinding disc 2 to the workpiece 1 is merely transmitted at point 1*a* to the completely ground workpiece face. The grinding disc 2 has, therefore, at side 1*a*, a punctiform contact with the workpiece, so that the workpiece itself is not subjected to any substantial, radial pressure forces. This point 1*a* is situated at the location where the workpiece 1 is in fact completely ground by the disc. In the embodiment shown, this is the internal circumferential line U, while the internal circumferential section U1 of the workpiece 1 still needs to be ground away. The grinding disc wears away uniformly, therefore, in the form of a layer S, which corresponds to the grinding depth, so that, as long as this layer is still not fully worn, the grinding disc does not even need to be re-aligned or re-fed. With reference to FIGS. 3 and 4, this means, therefore, that, as long as a section X1 or X2 respectively of the surface of the grinding disc is available for the grinding process, the grinding disc does not need to be constantly trimmed, in contrast to previously known grinding methods.

With the proposal according to the invention, a very gentle method of internally grinding workpieces is possible at high speeds because, in contrast to known internal grinding methods where up to more than 90% of the forces act at right angles to the workpiece axis, the radial forces—because of the punctiform contact between the grinding disc 2 and the completely ground face of the workpiece 1 at point 1*a*—merely act via this point, while the major portion of the force is transmitted in an axial direction because of the inclined end face.

Figure 6:
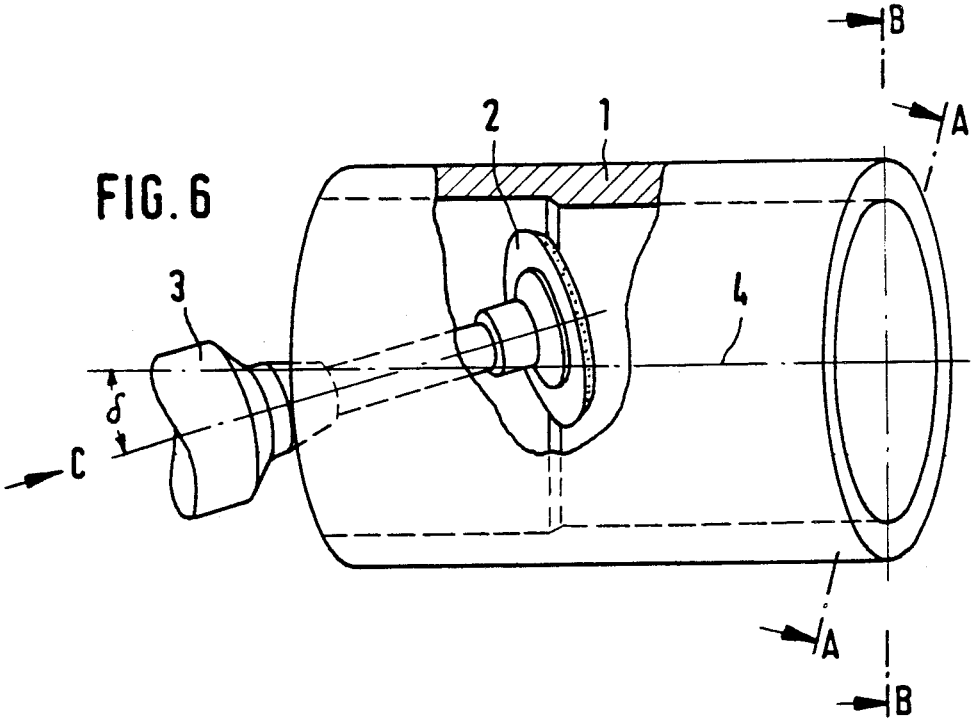
Figure 9:
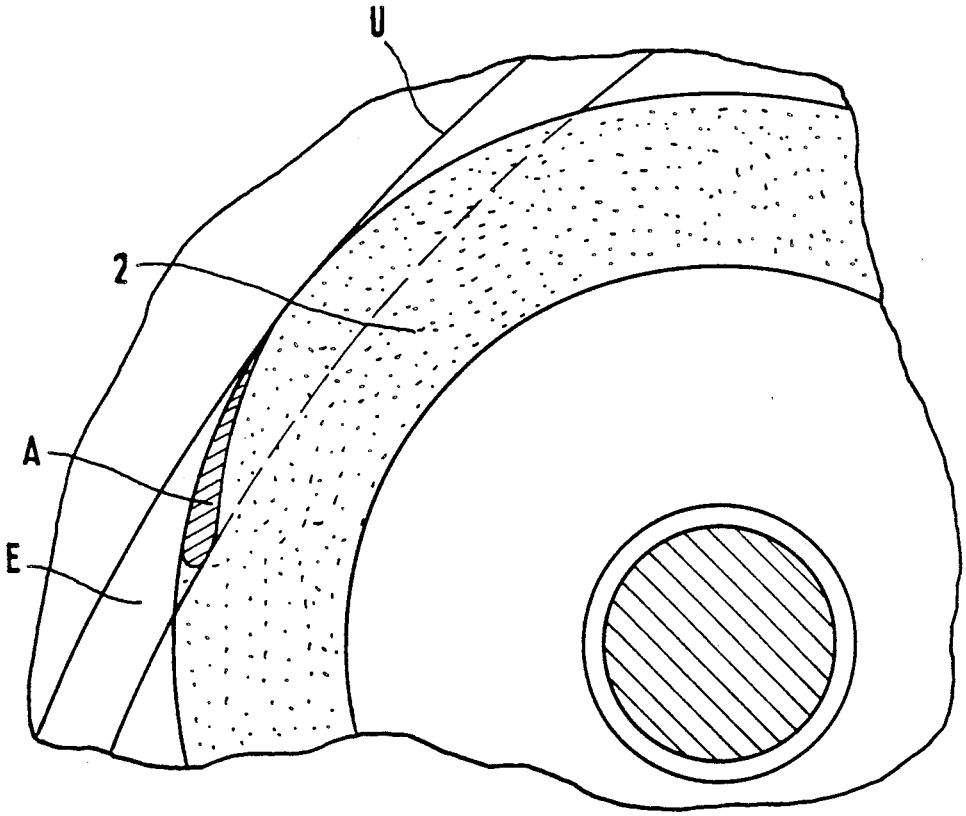
FIG. 9 is a view of the workpiece and disc according to arrow C of FIG. 6.

FIG. 9 is a cross-sectional view taken in the direction of arrow C in FIG. 6. The contact face A of the grinding disc is shown here in a hatched manner. It is apparent that the size of the face is dependent on the following three parameters: the diameter of the grinding disc, the internal diameter of the workpiece, and the grinding feed S. These parameters can be optimized for each particular grinding task. E is the annular face here which results from the feed.

One working example is shown below, relating to an optimum ratio between the diameter of the grinding disc and the internal diameter of the hollow workpiece to be machined, and relating to the determinative parameters:

| | |
|---|---|
| Diameter of the grinding disc: | 30 mm; |
| Bore diameter of the workpiece: | 50 mm; |
| Attainable r.p.m. of the workpiece: | $6000^{1}$/min; |

-continued

| | |
|---|---|
| Attainable r.p.m. of the grinding disc: | 80000 1/min; |
| Maximum depth of insertion (feed depth): | 0.2 mm; |
| Grinding disc used: | CBN; |
| Spped of advancement of workpiece relative to grinding disc: | 3 mm/s; |
| Pivotal angle: | 0.2°. |

The contact face A, shown in FIG. 9, is produced from the existing geometrical circumstances and, in respect of its form and size, is dependent on the Internal diameter of the workpiece;

Diameter of the grinding disc;

Pivotal angle;

Angle $\alpha+\delta$;

Offset disposition of axes D;

Feed depth S.

A conical cross-sectional area of the form shown is therefore produced. This area is clearly smaller than the one which is produced when the operation is carried out with the same grinding disc diameter, bore diameter and feed depth, but in a coaxial position (grinding spindle axis and workpiece axis). As a result of this small area, cooling can be achieved in a substantially more effective manner during the operation.

Because of the concept of the described apparatus, it has proved essential to permit the coolant and lubricant to penetrate as far as the engagement face of the grinding disc as a consequence of the clearance angle between the generatrix of the grinding disc and the internal configuration of the workpiece. Accordingly, substantially less heat is produced, yet the emission of heat is increased. It is a crucial advantage of the apparatus that the workpiece suffers no thermal damage or hardening of its edge layer, so that, according to the invention, even soft materials up to and including plastics materials can be ground with CBN grinding discs (cubic boron nitride).

I claim:

1. Apparatus for internally grinding a rotationally-symmetrical workpiece, which is clamped in position in a grinding machine so as to the rotatable about its longitudinal axis, said apparatus having a grinding disc which is displaceable along the rotational axis of the workpiece and is radially displaceable according to an internal profile to be ground, wherein the grinding disc, which abuts only against an end face of the workpiece, has a generatrix which extends in a flat manner and, by subtending a small clearance angle $\gamma$, is guided toward the area of the workpiece to be machined, and wherein a further clearance angle $\delta$ is formed by a skewed disposition of the axes of the grinding disc and of the workpiece relative to one another, the grinding disc and the completely ground workpiece face making contact at a point, the axis of the grinding disc lying in a plane spaced by a distance D from a horizontal plane in which the axis of workpiece lies causing the point of contact to be on the leading edge of the grinding disc.

2. An apparatus according to claim 1, wherein the grinding disc is cylindrical in shape.

3. An apparatus according to claim 1, wherein the grinding disc is frustoconical in shape.

* * * * *